United States Patent [19]

Sorokan

[11] Patent Number: 4,823,870

[45] Date of Patent: Apr. 25, 1989

[54] CANTILEVER DRILLING STRUCTURE

[76] Inventor: Ronald S. Sorokan, 14 Aspen Heights, 2330 Township, Rd 522, Sherwood Park, Alberta, Canada T8B 1H8

[21] Appl. No.: 227,492

[22] Filed: Aug. 1, 1988

Related U.S. Application Data

[63] Continuation of Ser. No. 022,610, Mar. 3, 1987, abandoned, Continuation of Ser. No. 629,100, Jul. 9, 1984, abandoned.

[51] Int. Cl.[4] ..... E21B 7/00; E21B 15/00

[52] U.S. Cl. ..... 166/79; 175/85; 175/202; 405/201; 52/117

[58] Field of Search ..... 166/79; 175/85, 202; 405/201; 180/140; 280/43.24; 52/115, 116, 117, 121, 143

[56] References Cited

U.S. PATENT DOCUMENTS

| | | | |
|---|---|---|---|
| 3,033,525 | 5/1962 | Johnson | 405/201 X |
| 4,033,427 | 7/1977 | Sturesson | 180/140 |
| 4,290,495 | 9/1981 | Elliston | 52/115 X |
| 4,296,820 | 10/1981 | Loftis | 175/85 X |
| 4,324,077 | 4/1982 | Woolslayer | 280/43.24 X |
| 4,375,892 | 3/1983 | Jenkins et al. | 52/143 X |
| 4,483,644 | 11/1984 | Johnson | 405/201 |

*Primary Examiner*—Stephen J. Novosad
*Assistant Examiner*—Terry Lee Melius
*Attorney, Agent, or Firm*—Lalos & Keegan

[57] ABSTRACT

A cantilevered drilling structure including a base unit having a side positionable generally adjacent a well head, and a drilling rig mast assembly positioned generally above and supported by the base unit. The base unit has a cantilever member extending out from its side, spaced from the ground, and having an outer portion spaced from the side. A telescoping leg extends down from the outer portion and is spaced from the side such that the side and the leg are positionable on opposite sides of a well head. The telescoping leg is movable between a lower support position and a higher raised position high enough to pass over flow lines when the drilling structure is moved along the well row. A skidding floor mechanism moves the drilling rig mast assembly along the base unit between a drilling position over the cantilever member when the telescoping leg has been extended and a moving position closer to the center of gravity of the base unit. When the drilling rig mast assembly is in its moving position and the telescoping leg in its higher raised position, the drilling structure can be rolled on a wheel assembly to a new location, for example, between two existing wells.

54 Claims, 11 Drawing Sheets

CANTILEVER DRILLING STRUCTURE

This is a continuation of co-pending application Ser. No. 022,610 filed on Mar. 3, 1987 now abd. which is a continuation of application Ser. No. 06/629,100 filed on 7/9/84, now abandoned.

BACKGROUND OF THE INVENTION

The present invention relates to drilling rigs and to methods of moving them from well to well. In the past, rigs were set up to move in large pieces or in one piece from well to well. This was done by rolling the rig on large rubber tire wheels, skidding the rig on rails using winches or hydraulic jacks, or by mounting it on rollers that ride on rails and pulling the rig on these rails with a truck. Then after a rig is moved off of a well, a flow line is usually attached to the well head so that production can begin. These lines are typically positioned a few feet above ground level and are directed perpendicular to the well row. Any number of wells can be positioned in a row and spacing between wells in a row might range from 30 to 110 feet in a drilling area such as in North Ak. wherein the production wells are usually closely spaced and arranged in rows.

Existing rigs used in such drilling areas are configured to straddle the well row. Thus, once the flow or other lines are connected to the well head area, the rig cannot travel down the well row. This presents a problem if the operator decides to drill between two existing wells in a row. In that case in the past he would either have to remove the flow lines, or disassemble and reassemble the rig, or move the rig so that it is positioned in a direction perpendicular to the row from the opposite direction of the flow line extensions. The first two alternatives are very time consuming, costly and hazardous and the third is not always possible because there usually is not sufficient room in the lease or on the artificial offshore island for the rig to manuver.

OBJECTS OF THE INVENTION

Accordingly, it is the principal object of the present invention to provide a novel drilling structure or rig and a method for moving it relative to the well heads.

Another object of the present invention is to provide a novel drilling structure which is easily and quickly maneuverable in a small area, as on a small lease or on an artificial offshore island.

A further object of the present invention is to provide a novel drilling structure which is easily movable from a well to a nearby second well without the need for disassembling the rig or removing the flow lines.

A still further object of the present invention is to provide a novel drilling structure which is adapted to move along the well row without interfering with the flow lines.

Another object of the present invention is to provide a novel drilling structure which can readily, easily and safely drill between existing wells in a row so that the wells can be drilled closer together.

Other objects and advantages of the present invention will become more apparent to those persons having ordinary skill in the art to which the present invention pertains from the following description taken in conjunction with the accompanying drawings.

DESCRIPTION OF THE PREFERRED EMBODIMENT

Figure 13:
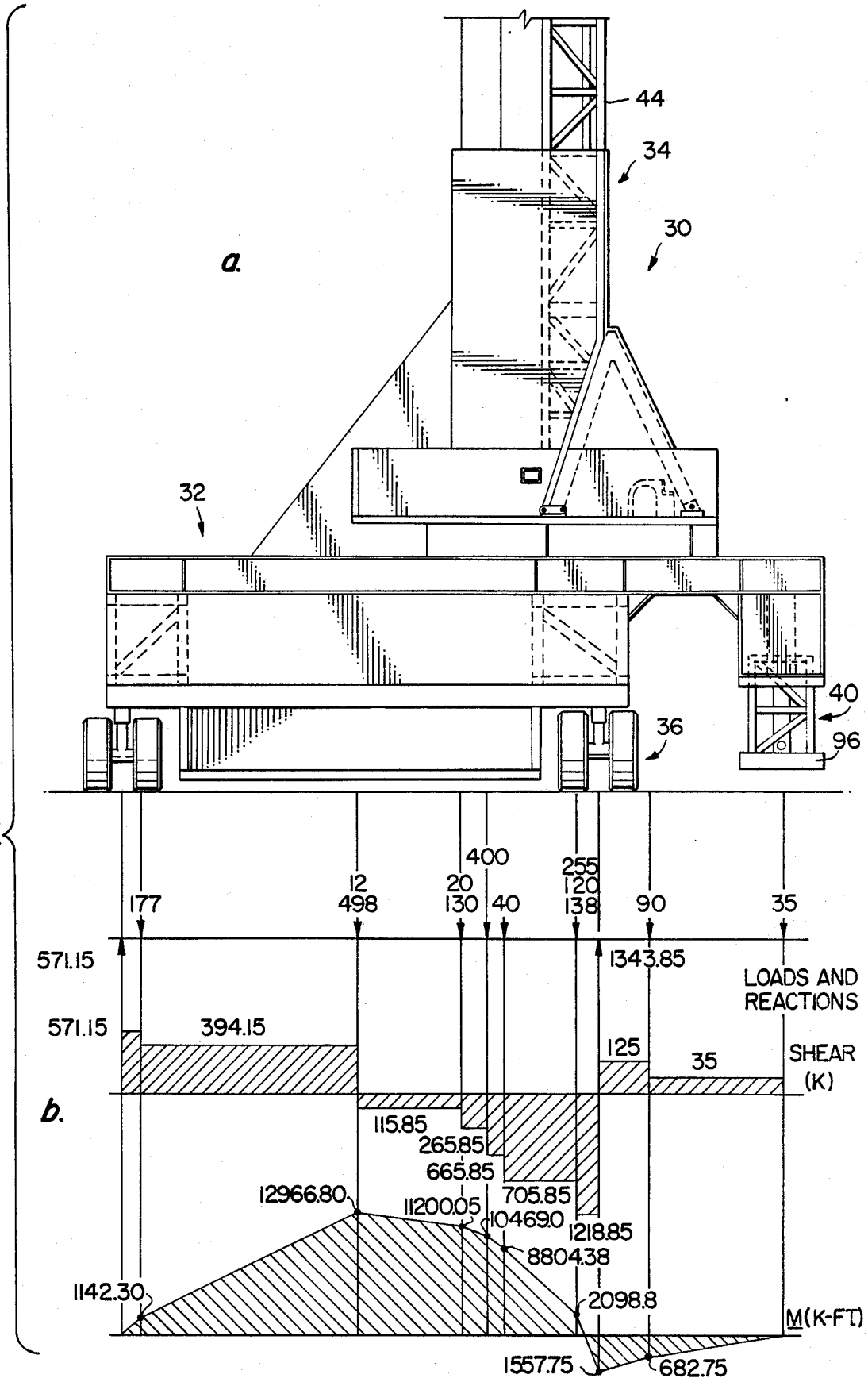
FIG. 13 is a schematic view of the drilling structure of FIG. 1 illustrating the structure weight, loads, and reactions.
Figure 17:
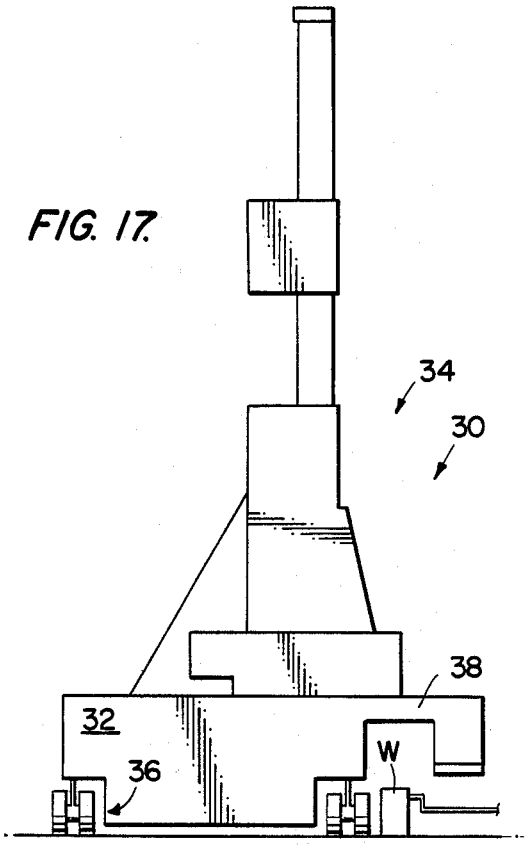

Referring to FIGS. 1 through 4 a preferred embodiment of the present drilling structure is illustrated generally at 30. Drilling structure 30 basically comprises a base unit shown generally at 32 and a drilling rig mast assembly, which is shown generally at 34, supported by and positioned above the base unit. Base unit 32 is movable on a wheel assembly shown generally at 36 and can be moved on wheel assembly 36 to a position adjacent the well head W. In lieu of the present wheel assembly a roller system (not shown) using a flat-top roller such as that manufactured by Hillman Equipment Co., Inc. of Wall, N.J., placed between the base unit and a stationary rail beam can be used, or alternatively, a greased skidding beam (not shown) supporting the base unit can be used. When adjacent well head W the cantilever portion 38 of base unit 32 is positioned so that it extends over well head W and the extendable support leg 40 extends down from the outer end of cantilever portion 38 until it rests on the ground thereby supporting the drilling rig structure. Drilling rig mast assembly 34 is movable on and relative to base unit 32 between a drilling position positioned over the well head and on cantilever portion 38, as illustrated schematically in FIG. 15, and a moving position, about twenty feet away, positioned away from cantilever portion 38 towards the center of gravity of base unit 32 thereby providing a more stable configuration for lifting legs 40 and moving drilling structure 30 relative to the well head W, as best shown in FIG. 17. As shown by the load, shear and moment diagrams of FIG. 13 when in the drilling position, drilling structure 30 provides a stable drilling platform able to accept the wind and other forces to which it might be subject with no toppling moment forces being produced at either end. For example, for a 34 mph wind from the rear the overturning moment is 1310.0K, and the load at the rear wheels is 551.00K and 1364.00K at the front wheels. Thus, the rig will not overturn.

Figure 7:
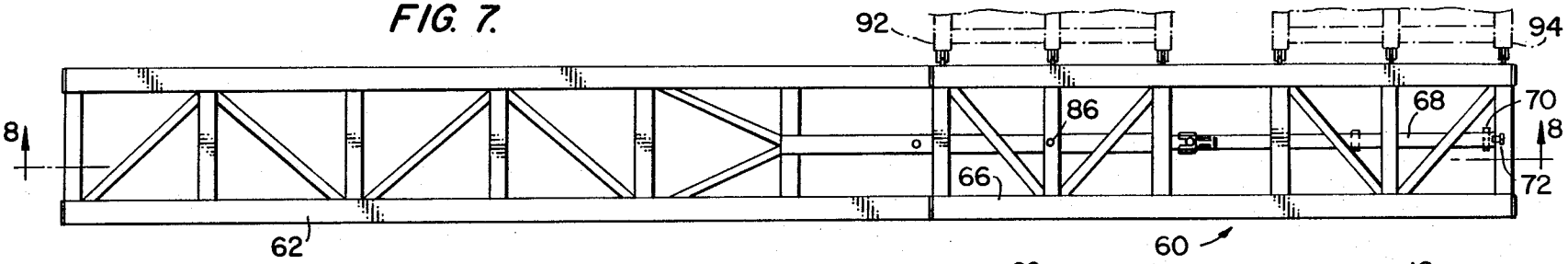
FIG. 7 is an enlarged top plan view of the drill floor skidding mechanism of the drilling structure of FIG. 1.
Figure 8:
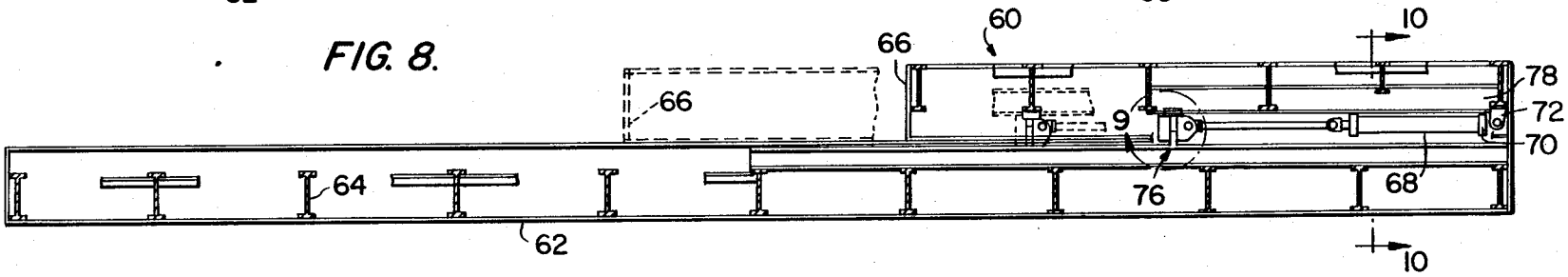
FIG. 8 is a cross-sectional view taken along line 8—8 of FIG. 8.
Figure 10:
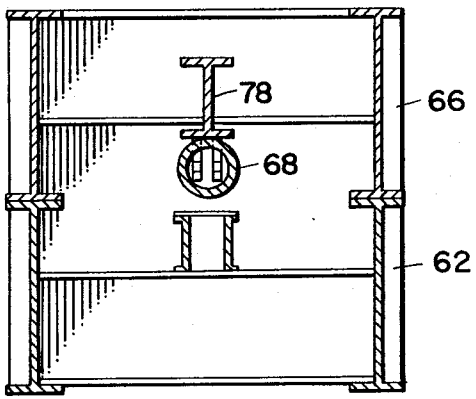
FIG. 10 is an enlarged cross-sectional view taken along line 10—10 of FIG. 8.
Figure 9:
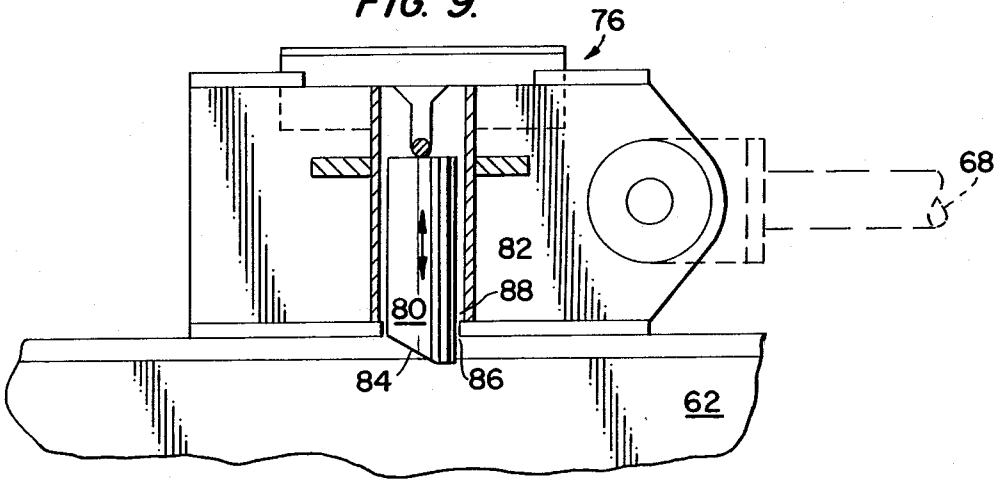
FIG. 9 is an enlarged view of the claw mechanism of FIG. 8.

Drilling rig mast assembly 34 includes a mast 44 having a crown portion 46 including suitable pulleys supporting the travelling equipment 50. Midway up the mast a racking board 52 is mounted, and suitable winterizing construction 54 is constructed around the lower end of mast 44 directly above the dog house 56 and the choke house 58. Drilling mast assembly 34 is moved by a skidding floor mechanism, shown generally at 60, along and relative to base unit 32 between its drilling position and its moving position. Skidding floor mechanism 60 is supported on a base girder framework 62 comprising a series of I beams 64 best illustrated in FIGS. 7, 8, and 10. A subbox structure 66 is skidded along base grider framework 62 and, is best illustrated in FIG. 8, where it is shown in its drilling position by solid lines and its skidded moving position by phantom lines. A hydraulic cylinder 68 is provided for moving subbox structure 66 relative to base girder framework 62. Hydraulic cylinder 68 is pivotally attached at one end 70 to the subbox structure by an ear means 72 and, at the other end 74, the cylinder rod end is pivotally connected to a skidding claw mechanism shown generally at 76. Skidding claw mechanism 76, which is best illustrated in FIG. 9, rides under and on the claw track rail 78 of subbox structure 66. The skidding claw mechanism includes a four inch diameter dowel pin 80 manually rotatable to accommodate the desired skidding direction. Pin 80 is mounted vertically in a steel box 82, and the bottom of the pin is bevelled only on one side 84.

Figure 4:
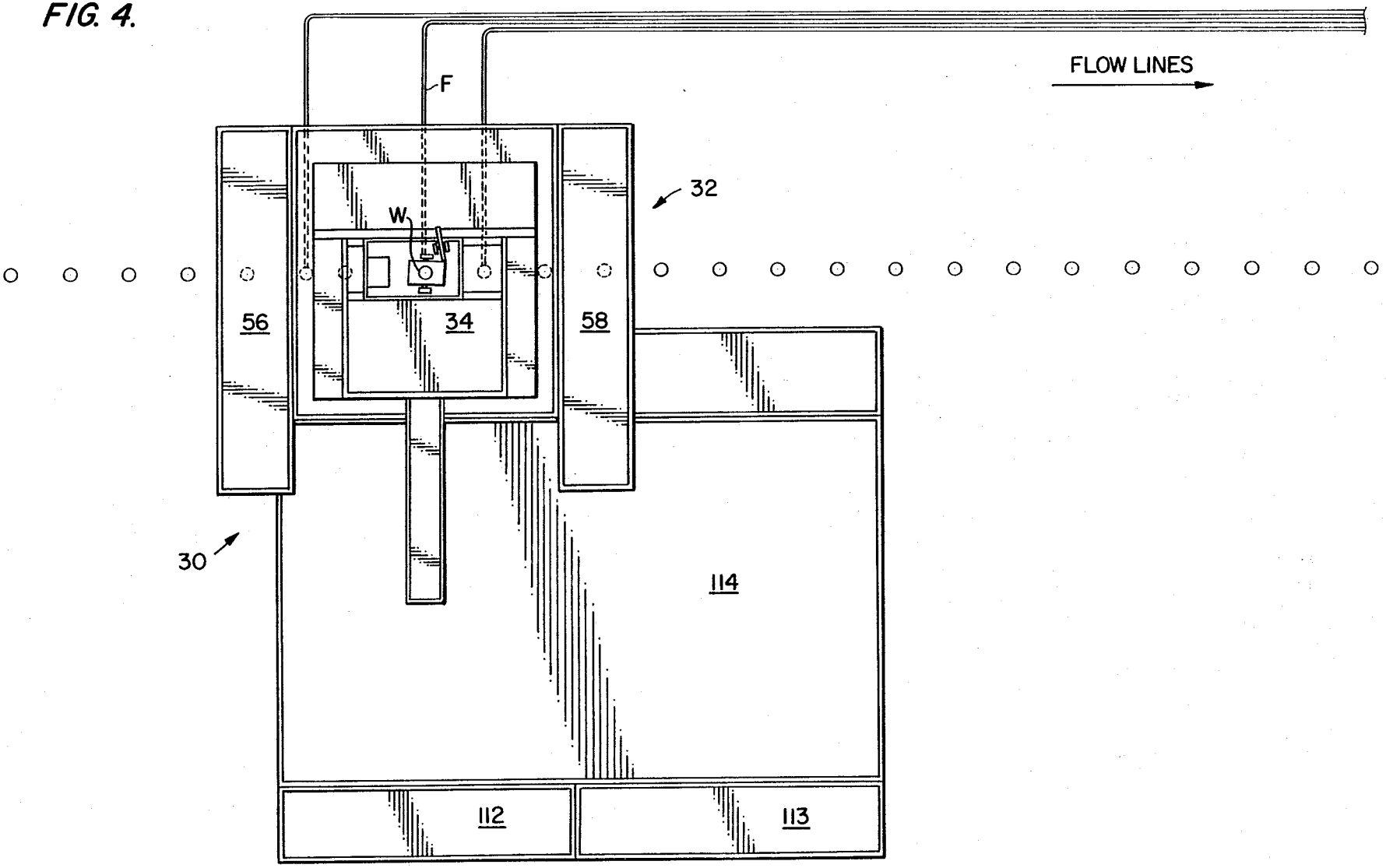
FIG. 4 is a top plan view of the drilling structure of FIG. 1 illustrated in its working environment.
Figure 14A:
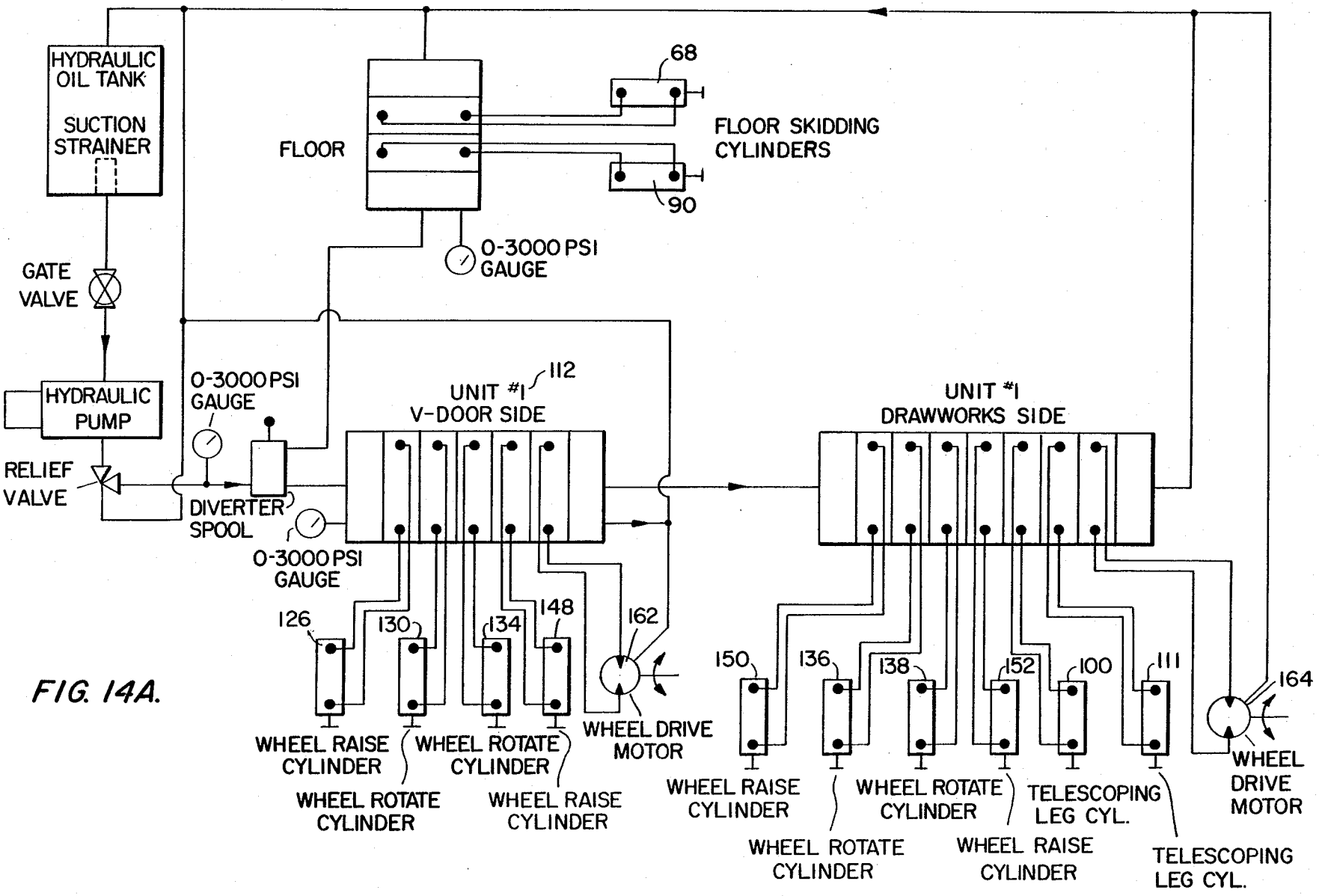
FIGS. 14A and 14B are schematic views of the hydraulic circuits for the drilling structure of FIG. 1.

To move the subbox structure 66 and thus drilling rig mast assembly 34 from its drilling position to its moving position, hydraulic cylinder 68 is extended. Due to the bevel 84 of pin 80, the pin will move up without providing any resistance. When the pin reaches the next dowel hole 86, the cylinder is retracted. Since pin 80 is not bevelled on this side 88, it can provide a resisting force and subbox structure 66 is moved or skidded forward to its new position. To reverse the skidding direction, pin 80 is rotated 180 degrees, and the cylinder accordingly extended and retracted. Subbox structure 66 illustrated in FIG. 4 is one of the two parallel-spaced subbox structures 66 and 90. The one of FIG. 8 is positioned on the off driller side and a parallel generally identical subbox 90 is positioned on the opposite side and a similar hydraulic cylinder 92 illustrated schematically in FIG. 14A is provided for subbox structure 90. Suitable setback spreaders 93 and draw work spreaders 94, illustrated in phantom lines in FIG. 7, are connected to and positioned between subbox structures 66 and 90 and, when drilling rig mast assembly 34 is positioned over the centerline of the wellhead in its drilling position as illustrated, set back spreaders 92 and drill work spreaders 94 are positioned on opposite sides of the well head. The setback spreaders form a platform on which the drill pipe can be stored when tripping out of the well and the drawwork spreaders support the large hoist drawworks.

Figure 5:
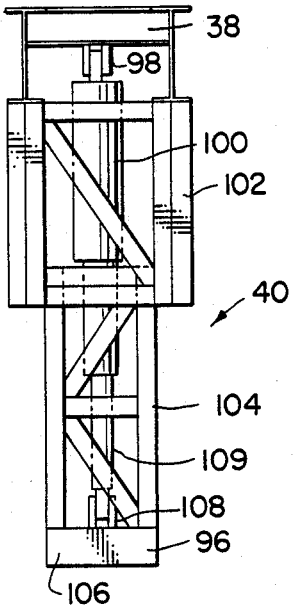
FIG. 5 is an enlarged side elevational view of one of the support legs of FIG. 3 illustrated from the drawworks side.
Figure 6:
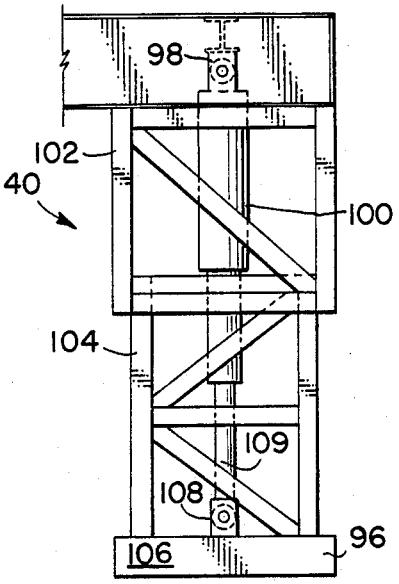
FIG. 6 is a side elevational view of the support leg of FIG. 5 illustrated from the driller's side.

Extendable support leg 40 positioned at the outer end of the cantilever portion 38 is designed to be positioned in a first support position wherein the lower end 96 of the leg rests on the ground and supports the outer end of cantilever portion 38 and in a second lifted position wherein the lower end of the support leg is raised and spaced above the ground a sufficient distance, e.g. four feet, so that it may pass over the flow lines F when repositioning drilling structure 30. Referring to FIGS. 5 and 6, it is seen that an ear assembly 98 is attached to and depends from cantilever portion 38. A hydraulic cylinder 100 is pivotally attached at its cylinder end to ear assembly 98. An outer frame structure 102 depends from and is attached to the outer end of the cantilever portion 38 and cylinder 100 is positioned inside of it. An inner frame structure 104 having an outer diameter narrower than the inner diameter of outer frame structure 102 is provided and adapted to slide within the outer frame structure. Inner frame structure 104 is provided with a foot member 106 attached at its lower end 96 and which provides a flat ground engaging surface. On the upper surface of the foot member 106 a lower ear member 108 is positioned to which the cylinder rod end 109 of cylinder 100 is pivotally attached. It thus can be readily seen that when cylinder 100 is in its extended position, as in FIGS. 4 and 5, the inner frame structure is pushed out, in a telescoping movement, of the outer frame structure into its lengthened support position. When cylinder rod 109 is retracted, the foot member 106 of the inner frame structure is retracted vertically up into the outer frame structure. A second parallel extendable support leg 110 (see FIG. 3) spaced from extendable support leg 40 is found on the other side of the well head and is also movable between support and lifted positions by a similar hydraulic cylinder 111 shown schematically in FIG. 14A. Suitable cellar winterizing doors (not shown) can be attached to close between the base unit and the legs when in the support position thereby sheltering the well head area.

Figure 1:
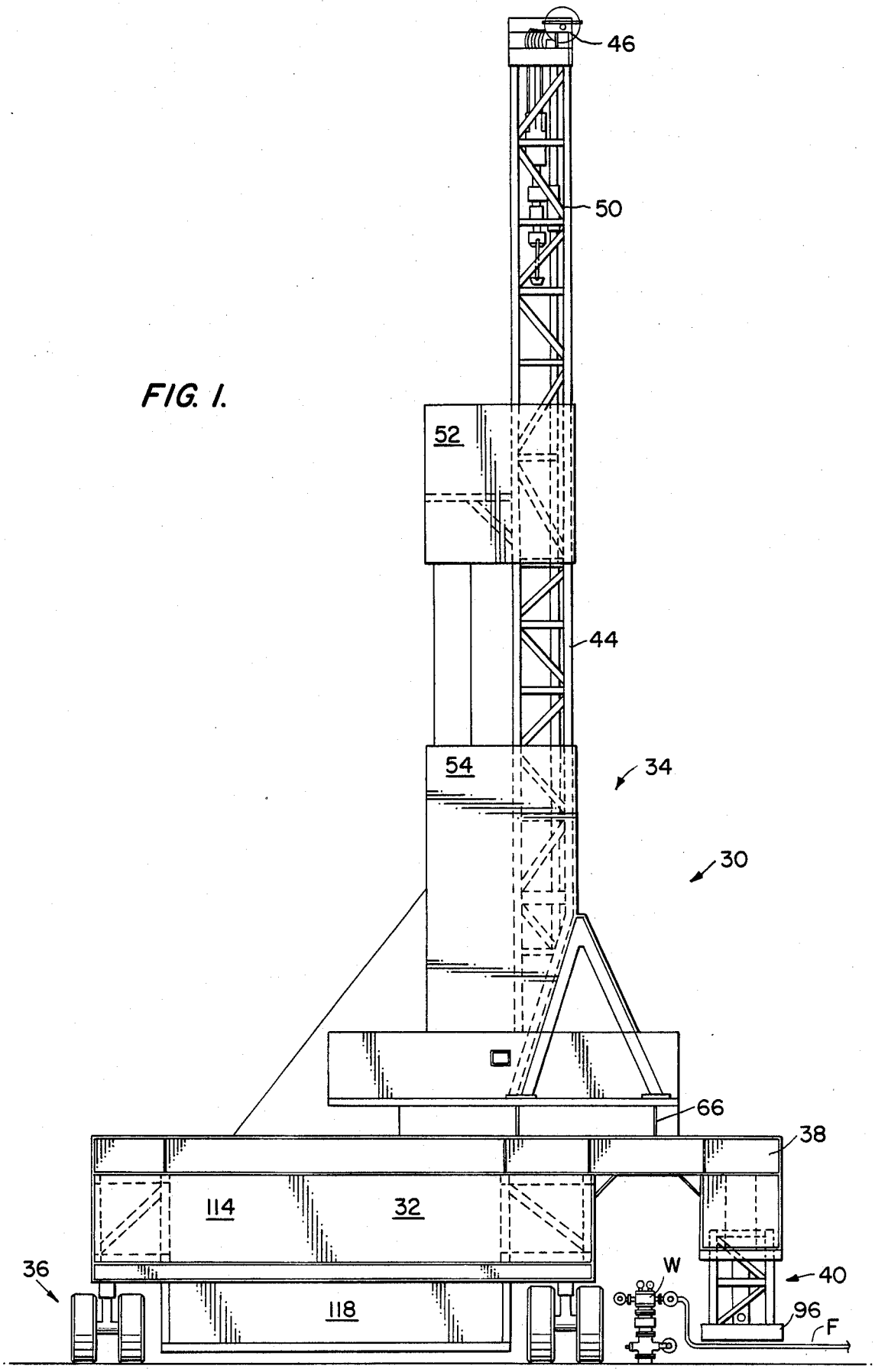
FIG. 1 is an elevational view of a drilling structure embodying the present invention illustrated from the "off-drillers" side.
Figure 2:
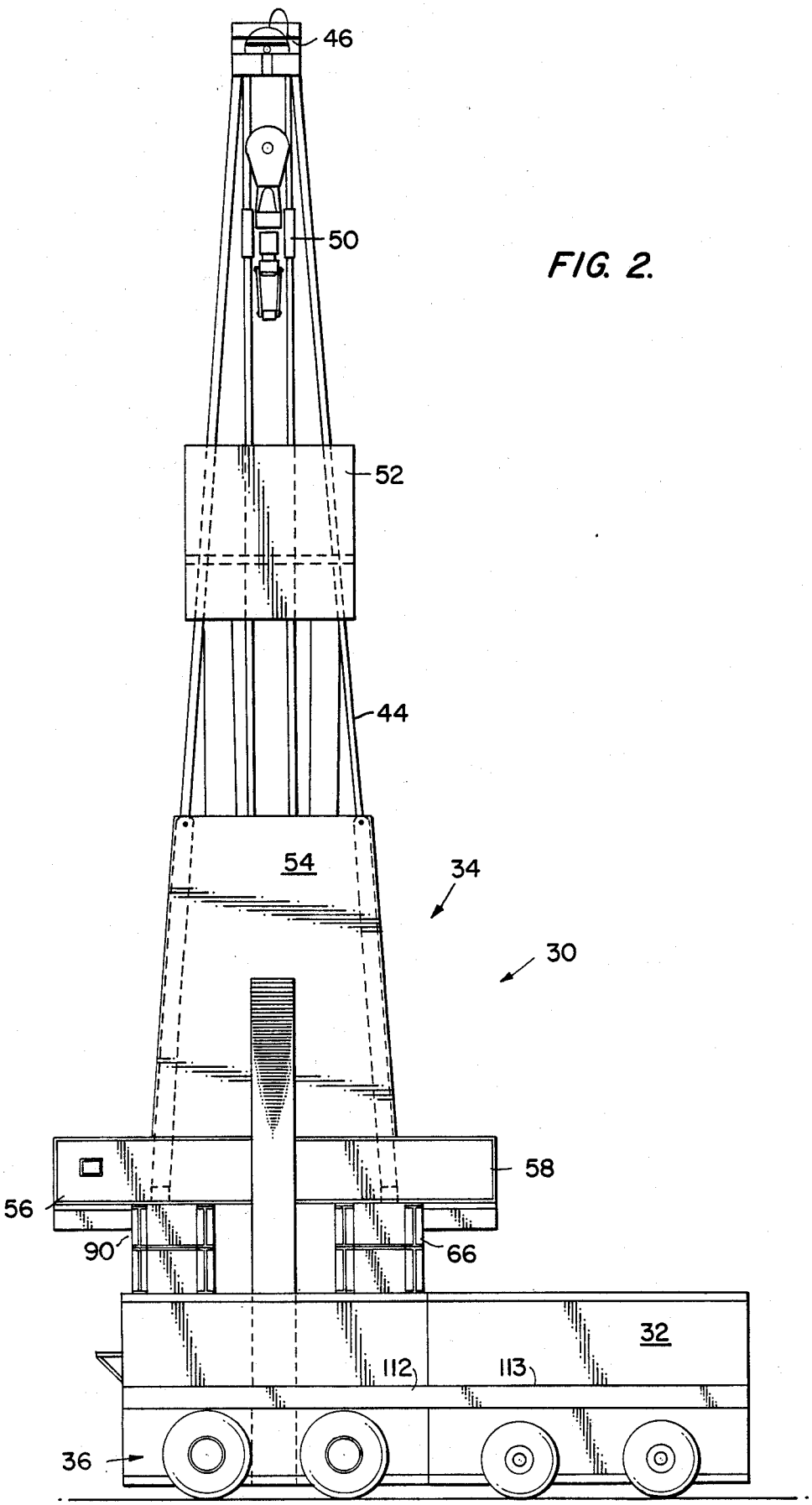
FIG. 2 is a side elevational view of the drilling structure of FIG. 1 illustrated from the "V"-door side.
Figure 3:
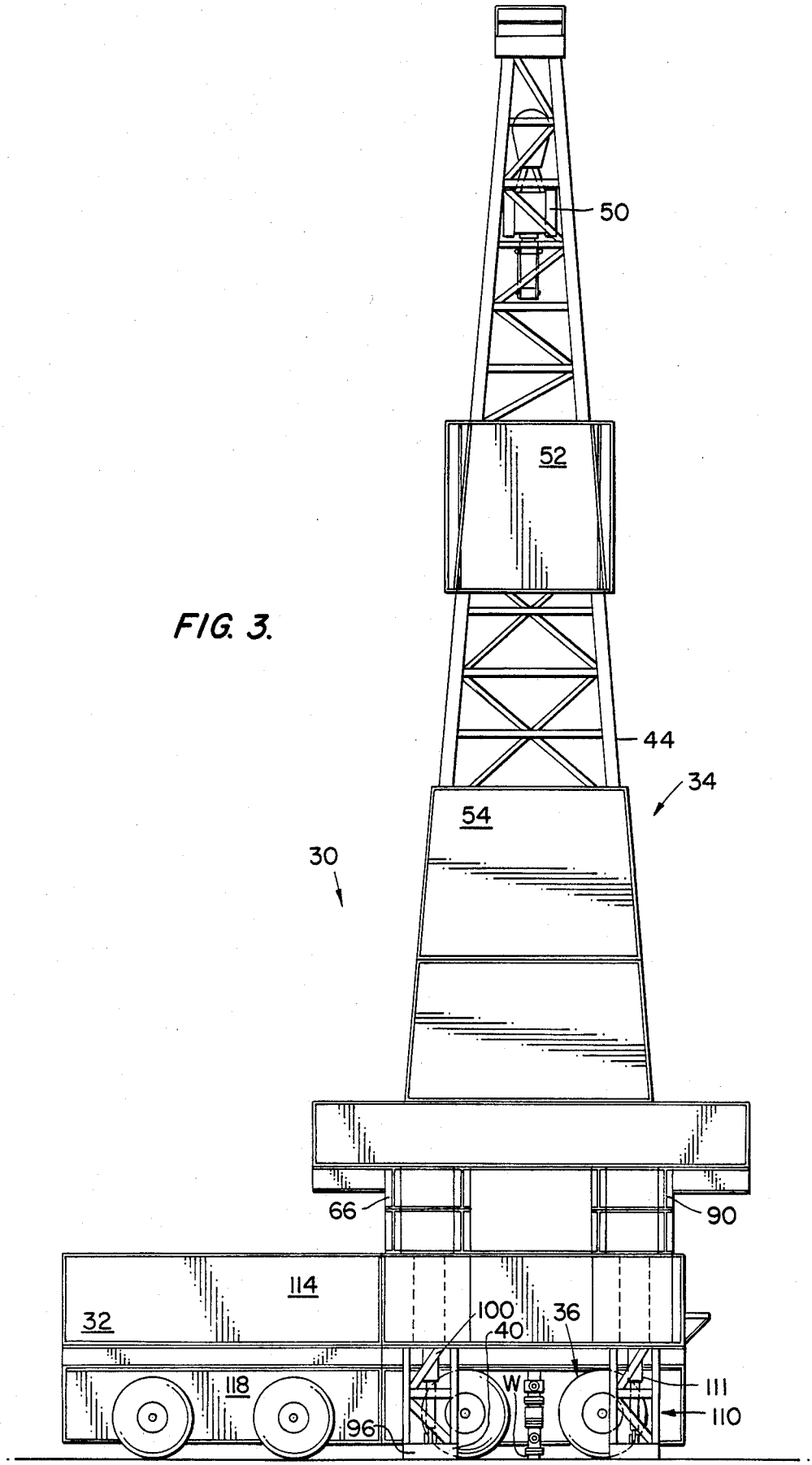
FIG. 3 is a side elevational view of the drilling structure of FIG. 1 illustrated from the "drawworks" side.
Figure 11:
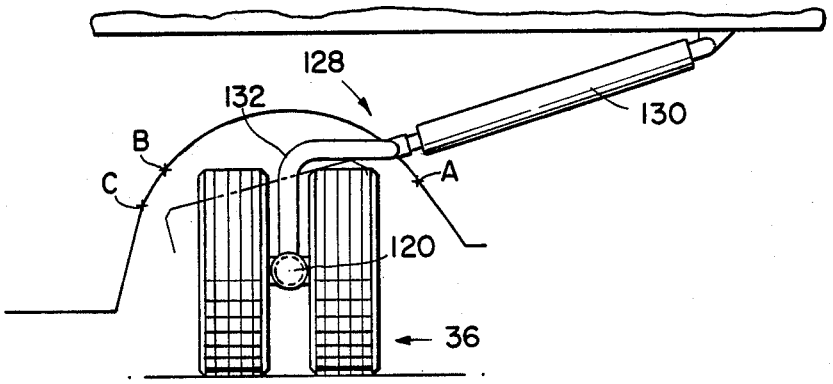
FIG. 11 is an enlarged plan view of the wheel steering assembly of the drilling structure of FIG. 1 illustrated in isolation and showing in detail the wheel steering mechanism.
Figure 12:
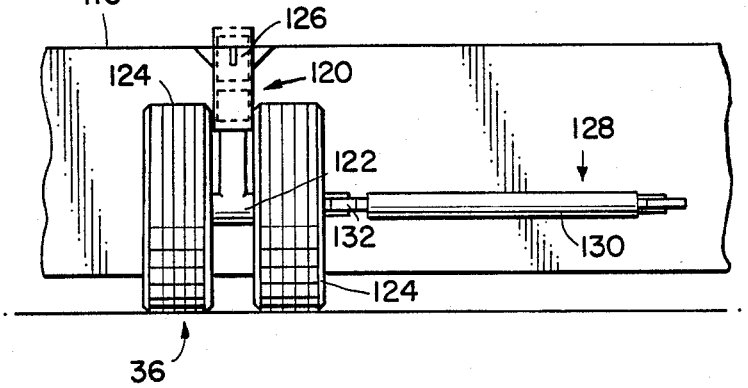
FIG. 12 is a side elevational view of the wheel steering assembly of FIG. 10 showing in detail the wheel raising and lowering mechanism.
Figure 14B:
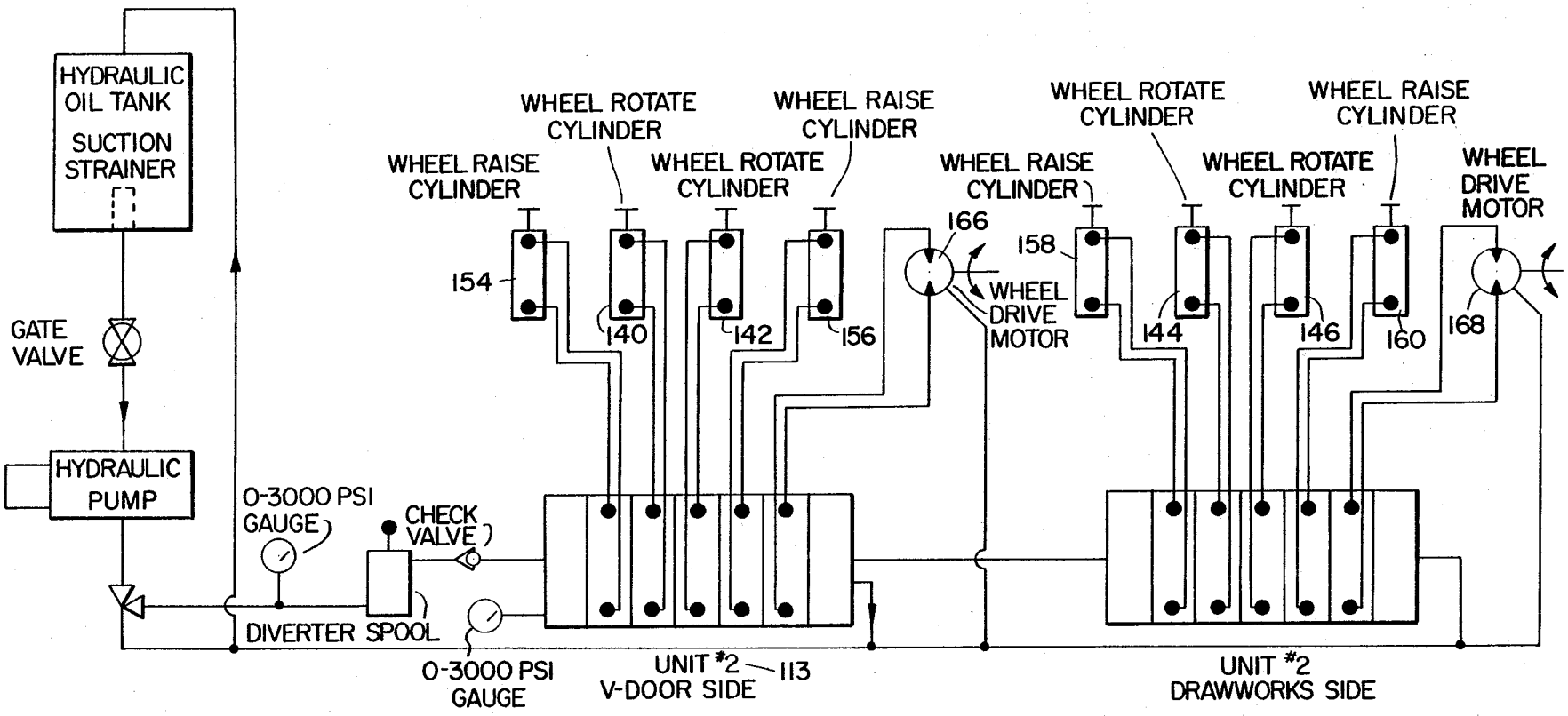

Base unit 32 comprises a first unit 112 and second unit 113 when viewed from the V door side as in FIG. 2. The upper portion of the base unit comprises a pipe and casing storage area 114 and positioned beneath pipe and casing storage area 114 are the equipment rooms and mud tanks, shown generally at 118. The present drilling rig structure is designed to rest on the equipment rooms and mud tanks 118 when in its drilling position and when it is desired to reorient the wheel assemblies 36. This is shown schematically in FIGS. 15 through 22. To raise base unit 32 off of the ground onto wheel assemblies 36, a wheel lifting mechanism, best shown at 120 in FIG. 12, is provided. It comprises essentially a T-shape member 122 with the pair of wheels 124 rotatably mounted on opposite ends of member 122 in a conventional manner. A double-acting hydraulic cylinder 126 with an approximate 36 inch stroke is attached at its cylinder end to a lower surface of the pipe and casing storage area 116. When energized it pushes against the middle leg portion of the T member 122 thereby pushing down on the wheel asssembly 36, forcing it against the ground and thereby lifting base unit 32 off of the ground until supported on the wheel assemblies 36. When it is desired to rotate the wheels 124 of wheel assembly 36 so that the drilling rig structure 30 can be maneuvered in at least a first direction and a second direction perpendicular to that first direction, a wheel steering mechanism, best illustrated generally at 128 in FIG. 11, is provided. Referring thereto, it is seen in a top plan view that double-acting hydraulic cylinder 130 having approximately a 14½ foot stroke is horizontally disposed and pivotally attached at one end to base unit 30. At its opposite end it is pivotally attached to an angle bar member 132 which in a horizontal plane defines a 90 degree angle. Angle bar member 132 is attached at its other end to the T-shaped member 122. When cylinder 130 is retracted as at point A the wheels are turned 15 degrees. When the cylinder is extended as at point B, the wheels are turned 90 degrees and when fully extended as at point C the wheels are turned an extra 15 degrees. Each of the other seven pairs of wheels of drilling structure 30 are provided with similar rotating cylinders illustrated schematically in FIGS. 14A and 14B at 134, 136, 138, 140, 142, 144, and 146, and lifting cylinders 148, 150, 152, 154, 156, 158, and 160.

Figure 15:
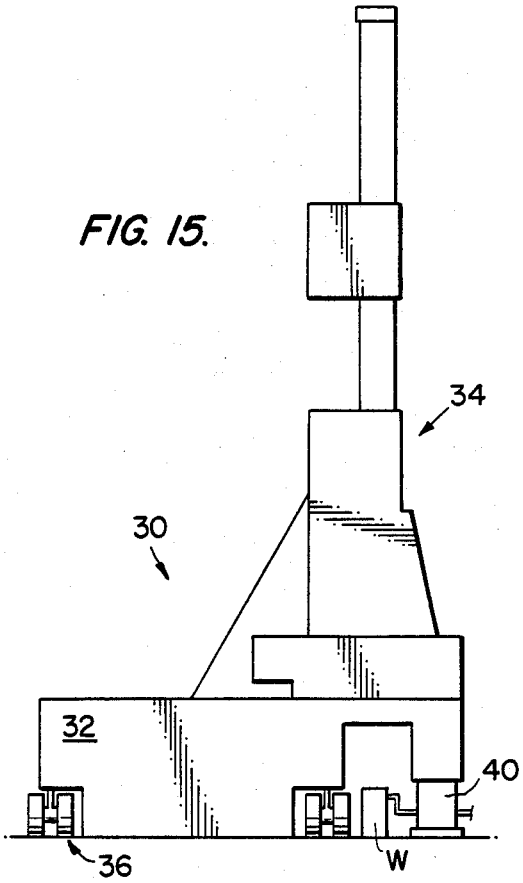
FIGS. 15 through 18 are side schematic views similar to FIG. 1 illustrating the operating sequence for moving the drilling structure along the well row.
Figure 16:
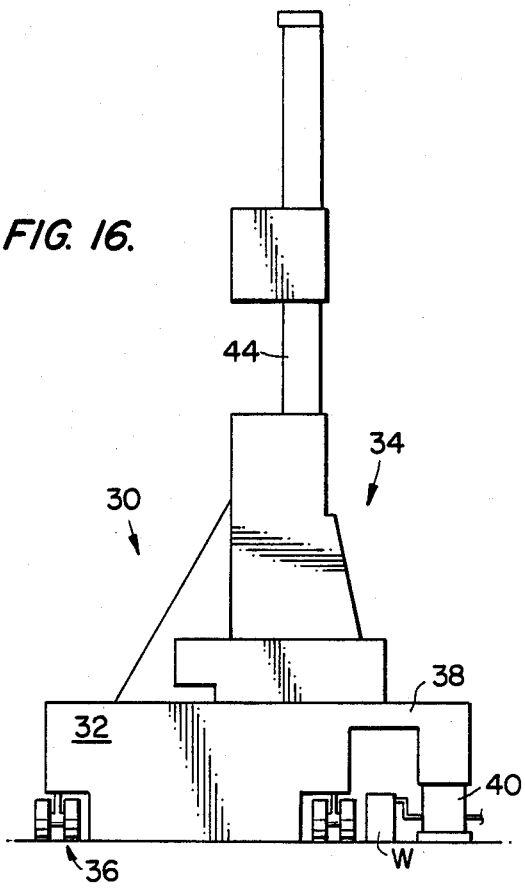
Figure 18:
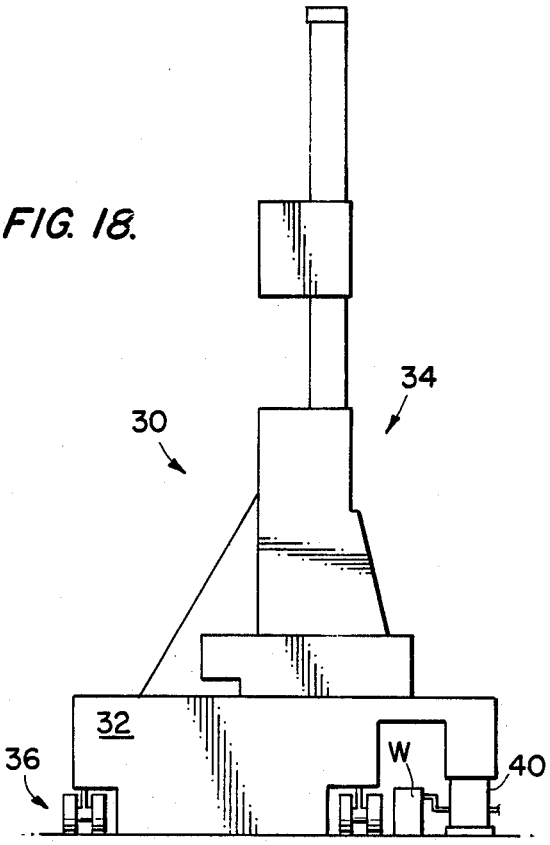

The operating procedure for moving the rig parallel to the well row is shown in FIGS. 15 through 18. As illustrated in FIG. 15, the rig is in its drilling position with drilling rig mast assembly 34 centered over the wellhead W. Drilling rig mast assembly 45 is then via the hydraulic skidding floor mechanism 60 skidded to its moving position in FIG. 16. The extendable support legs 40 are then lifted by retracting the hydraulic cylinders positioned therein. The entire rig is next lifted off of the ground by extending the wheel assembly cylinders with the wheels positioned in a direction generally parallel to the well row. With the rig in the position as shown in FIG. 17, the rig is driven by suitable hydraulic wheel drive motors, which are illustrated schematically at 162, 164, 166, and 168 in FIGS. 14A and 14B, with suitable hydraulic tanks, pumps, valves, and flow lines as shown being provided, on the wheel assemblies 36 to its new location or well. When at the new well the rig is lowered until resting on the ground by retracting the wheel assembly cylinders. The extendable support legs 40 are lowered by extending their hydraulic cylinders 100 until resting on the ground and supporting the outer end of the cantilever portion 38. Once positioned as shown in FIG. 18, drilling rig mast assembly 34 can then be skidded by skidding floor mechanism 60 to its drilling position over the new wellhead, as shown in FIG. 15, and drilling begun again.

Figure 19:
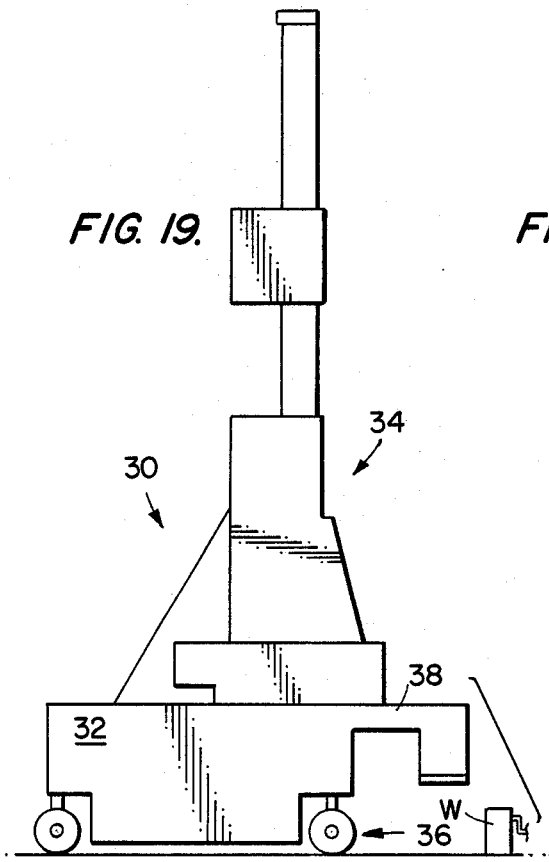
FIGS. 19 through 22 are sequential schematic views illustrating the movement of the sdrilling structure in a direction perpendicular to the well row.
Figure 20:
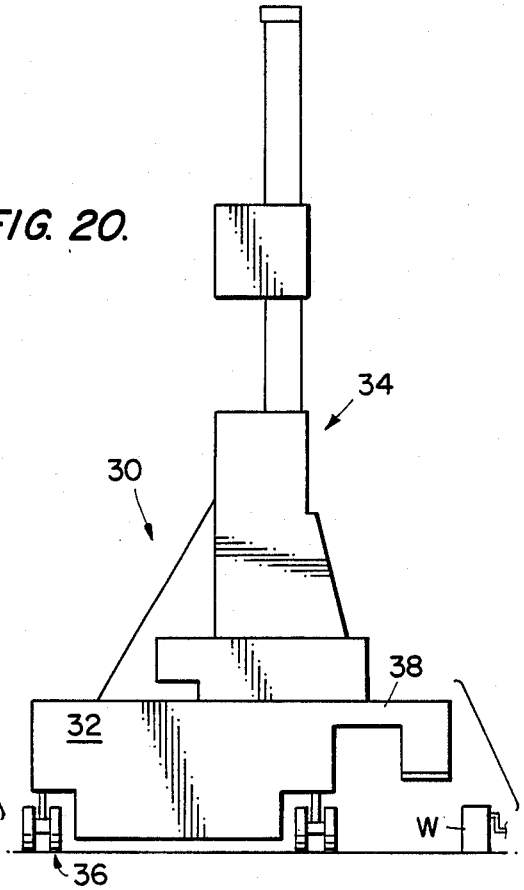
Figure 21:
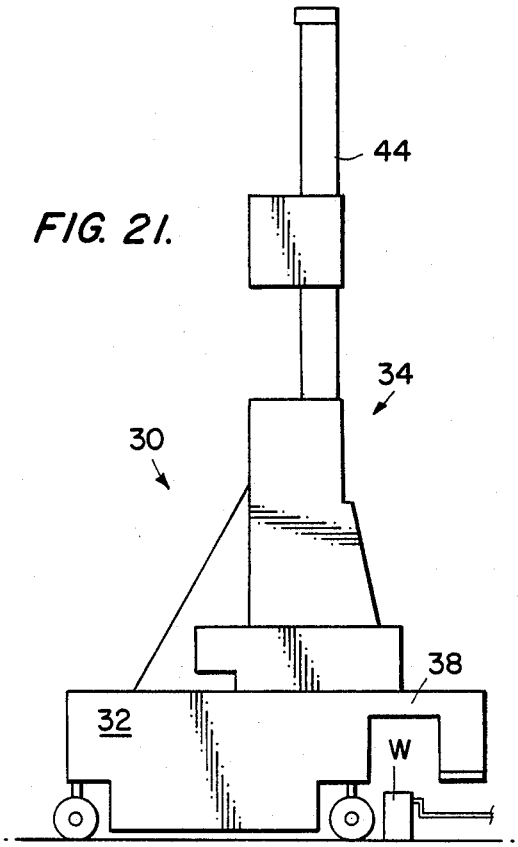
Figure 22:
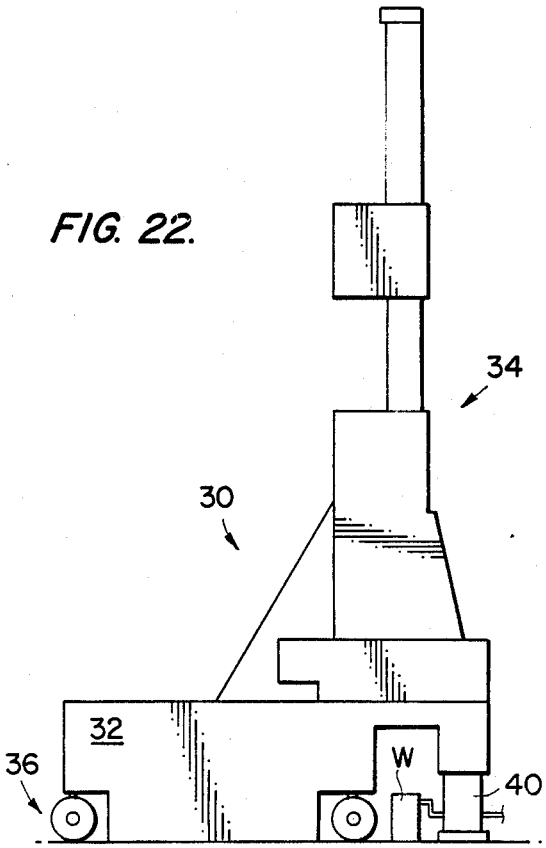

The procedure for moving the drilling structure 30 perpendicular to a well row is illustrated schematically in FIGS. 19 through 22. The wheels are first turned as shown in FIG. 19, the rig floor skidded by the skidding floor mechanism 60 to its transport position, the extendable support legs 40 and 110 lifted, the rig raised by lowering the wheel assemblies 36, and the entire rig moved by energizing the wheel drive motors 162, 164, 166, 168 out of the well row as shown in FIG. 19. As shown in FIG. 20, the rig is next lowered by raising the wheels, the wheels are then turned 90 degrees by extending the horizontal wheel assembly cylinder 130, the rig is raised by lowering the wheels by extending cylinder 126, and the rig is then driven by its motors in a direction parallel to the well row. The next step, illustrated in FIG. 21, involves lowering the rig by raising the wheels by retracting cylinder 126, turning the wheels 90 degrees by retracting the horizontal wheel assembly cylinder 130, and moving the rig back over the well row. Now at the new well row when it is desired to place the rig in its drilling position, as shown in FIG. 22, the rig is lowered by raising the wheels, the extendable support legs are lowered, and the rig floor is skidded to its drilling position extending out on the cantilever portion until positioned over the new well. The entire moving procedures as just described are thus accomplished easily, quickly and without the need for disassembling and reassembling either the drilling rig structure on the flow lines.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. A drilling structure comprising:

a base unit having a side positionable generally adjacent a well head, a friction reducing means supporting said base unit on a support surface on which said base unit is movable, a drilling rig mast assembly positioned generally above and supported by said base unit, said base unit including a cantilever member extending out from said side of said base unit in a fixed position relative to said side of said base unit, a positioning means for sliding said drilling rig mast assembly on and relative to said cantilever member between a drilling position over said cantilever member and a moving position disposed away from said outer portion of said cantilever member and closer to the center of gravity of said base unit than is said drilling position.

2. The drilling structure of claim 1 including a leg means extending down from said outer portion of said cantilever member and spaced from said side such that said side and said leg means are positionable on opposite sides of a well head, said leg means being movable between a lower support position and a higher raised position.

3. The drilling structure of claim 2 including, said raised position being spaced a distance sufficient to pass over a flow line associated with the well head when said base unit is moved on said friction reducing means relative to the well head and along the well row.

4. The drilling structure of claim 2 including, a moving means operatively connected to said leg means for moving said leg means between said support position and said raised position.

5. The drilling structure of claim 4 including, said leg means comprising a telescoping leg and a leg cylinder means attached to said telescoping leg for telescoping said telescoping leg between said support position and said raised position.

6. The drilling structure of claim 5 including, said telescoping leg comprising a first frame member mounted to and depending down from said cantilever member, and a second frame member slidable within said first frame member, and said leg cylinder means having its lower end attached to a lower portion of said second frame member and at least a portion of said leg cylinder means being positioned in said first frame member.

7. The drilling structure of claim 1 wherein, said drilling rig mast assembly includes a frame assembly movable relative to said cantilever member, and said positioning means includes an extendable-retractable cylinder means attached at one end to said frame assembly and a grasping means at the other end for grasping said base unit, and when said extendable-retractable cylinder means is powered and said grasping means grasps said base unit for moving said drilling rig mast assembly along said cantilever member.

8. The drilling structure of claim 7 wherein, said grasping means includes a pin means extending out from said other end and adapted to engage openings in said cantilever member.

9. The drilling structure of claim 8 including, said pin mean including a beveled face portion rotatably positionable so that it faces the desired direction of travel of said extendable-retractable cylinder means.

10. The drilling structure of claim 1 including, said base unit including a pipe and casing storage area, an equipment area, and at least one mud tank, and said drilling rig mast assembly including a doghouse, a choke house, and at least one rig floor side box.

11. The drilling structure of claim 1 including, said friction reducing means comprising a wheel assembly connected to said base unit, and said wheel assembly being movable between a parallel position parallel to the well row and an angled position disposed angularly to said parallel position for movement towards and away from the well row.

12. The drilling structure of claim 11 including, said angled position being perpendicular to said parallel position.

13. The drilling structure of claim 11 including, a turning means connected to said wheel assembly for turning said wheel assembly between said parallel position and said angled position.

14. The drilling structure of claim 13 including, said turning means including an extendable cylinder assembly connected at one end to said base unit and at the other end by a connection mechanism to said wheel assembly.

15. The drilling structure of claim 14 including, said connection mechanism comprising a rigid member having a first portion connected to and extending from said wheel assembly and a second portion secured to an end of said first portion and angling towards and connected to said extendable cylinder assembly.

16. The drilling structure of claim 1 including, said friction reducing means comprising a wheel assembly connected to said base unit, and a raising means for rising said wheel assembly relative to said base unit so that said base unit can rest on the support surface and for lowering said wheel assembly relative to said base unit so that said base unit can be lifted off of the support surface and supported by said wheel assembly.

17. The drilling structure of claim 16 including said raising means providing a vertical axis about which said wheel assembly is rotatable, and a turning means operatively connected to said wheel assembly for rotating said wheel assembly about said vertical axis when said wheel assembly is in its raised position and thereby changing the orientation of said wheel assembly relative to said base unit.

18. The drilling structure of claim 16 including, said raising means comprising a vertically-disposed, double-acting hydraulic cylinder means.

19. A drilling structure comprising:

a base unit having a side positionable generally adjacent a well head, a friction reducing means supporting said base unit on a support surface and on which said base unit is movable, a drilling rig mast assembly positioned generally above and supported by said base unit, said base unit including a cantilever member extending out from and fixed in position relative to said side and spaced from the ground and having an outer portion spaced from said side, a leg means extending down from said outer portion and spaced from said side such that said side and said leg means are positionable on opposite sides of a well head, said leg means being movable between a lower support position and a higher raised position, said leg means comprising a vertical telescoping leg and a vertical leg moving means attached to said telescoping leg for telescoping said telescoping leg between said support position and said raised position.

20. The drilling structure of claim 19 wherein, said vertical leg moving means comprises a cylinder.

21. The drilling structure of claim 20 wherein, said telescoping leg comprises a first frame member mounted to and depending down from said cantilever member, and a second frame member slidable within said first frame member.

22. The drilling structure of claim 21 wherein, said cylinder has its lower end attached to a lower portion of said second frame member and at least a portion of said cylinder is positioned in said first frame member.

23. A drilling structure comprising:

a base unit having a side positionable generally adjacent a well head, a friction reducing means supporting said base unit on a support surface and on which said base unit is movable, a drilling rig mast assembly positioned generally above and supported by said base unit, said base unit including a cantilever member extending out from and fixed in position relative to said side and spaced from the ground and having an outer portion spaced from said side, a leg means extending down from said outer portion and spaced from said side such that said side and said leg means are positionable on opposite sides of a well head, said leg means being movable between a lower support position and a higher raised position, said leg means comprising a vertical telescoping leg and a vertical leg cylinder means attached to said telescoping leg for telescoping said telescoping leg between said support position and said raised position, said telescoping leg comprising a first frame member mounted to and depending down from said cantilever member, and a second frame member slidable within said first frame member, and said leg cylinder means having its lower end attached to a lower portion of said second frame member and at least a portion of said leg cylinder means being positioned in said first frame member.

24. The drilling structure of claim 23 including, a mounting means for fixedly mounting said cantilever member to said side.

25. A drilling structure comprising:

a base unit having a side positionable generally adjacent a well head, a friction reducing means supporting said base unit on a support surface and on which said base unit is movable, a drilling rig mast assembly positioned generally above and supported by said base unit, said base unit including a cantilever member extending out from and fixed in position relative to said side and spaced from the ground and having an outer portion spaced from said side, a leg means extending down from said outer portion and spaced from said side such that said side and said leg means are positionable on opposite sides of a well head, said leg means being movable between a lower support position and a higher raised position, a positioning means for positioning said drilling rig mast assembly on and relative to said cantilever member between a drilling position over said cantilever member and a drilling structure moving position disposed away from said outer portion and closer to the center of gravity of said base unit than said drilling position, said drilling rig mast assembly including a frame assembly movable relative to said cantilever member, and said positioning means including an extendable-retractable cylinder means attached at one end to said frame assembly and a grasping means at the other end for grasping said base unit and, when said extendable-retractable cylinder means is powered and said grasping means graps said base unit, for moving said drilling rig mast assembly along and relative to said cantilever member.

26. The drilling structure of claim 25 including, said base unit including a pipe and casing storage area, an equipment area, and at least one mud tank, and said drilling rig mast assembly including a doghouse, a choke house, and at least one rig floor side box.

27. The drilling structure of claim 25 including, said drilling rig mast assembly being vertical and upright when in said drilling structure moving position.

28. A drilling structure comprising:

a base unit having a side positionable generally adjacent a well head, a friction reducing means supporting said base unit on a support surface and on which said base unit is movable, a drilling rig mast assembly positioned generally above and supported by said base unit, said base unit including a cantilever member extending out from and fixed in position relative to said side and spaced from the ground and having an outer portion spaced from said side, a leg means extending down from said outer portion and spaced from said side such that said side and said leg means are positionable on opposite sides of a well head, said leg means being movable between a lower support position and a higher raised position, said friction reducing means comprising a wheel assembly connected to said base unit, and said wheel assembly being movable between a parallel position parallel to the well row and an angled position disposed angularly to said parallel position for movement of said base unit towards and away from the well row, and a turning means connected to said wheel assembly for turning said wheel assembly between said parallel position and said angled position.

29. The drilling structure of claim 28 including, said angled position being perpendicular to said parallel position.

30. The drilling structure of claim 28 including, said turning means including an extendable cylinder assembly connected at one end to said base unit and at the other end by a connection mechanism to said wheel assembly.

31. The drilling structure of claim 30 including, said connection mechanism comprising a rigid member having a first portion connected to and extending from said wheel assembly and a second portion secured to an end of said first portion and angling towards and connected to said extendable cylinder assembly.

32. The drilling structure of claim 28 including, said wheel assembly including first and second axles, and said turning means including a first extendable cylinder assembly connected at one end to said first axle and at its opposite end to said base unit.

33. The drilling structure of claim 32 including, said turning means including a second extendable cylinder assembly connected at one end to said second axle and at its opposite end to said base unit.

34. A drilling structure comprising:

a base unit having a side positionable generally adjacent a well head, a friction reducing means supporting said base unit on a support surface and on which said base unit is movable, a drilling rig mast assembly positioned generally above and supported by said base unit, said base unit including a cantilever member extending out from and fixed in position relative to said side and spaced from the ground and having an outer portion spaced from said side, a leg means extending down from said outer portion and spaced from said side such that said side and said leg means are positionable on opposite sides of a well head, said leg means being movable between a lower support position and a higher raised position, said friction reducing means comprising a wheel assembly connected to said base unit, a raising means for raising said wheel assembly relative to said base unit so that said base unit can rest on the support surface and for lowering said wheel assembly relative to said base unit so that said base unit can be lifted off of the support surface and supported by said wheel assembly, said raising means defining a vertical axis about which said wheel assembly is rotatable, and a turning means operatively connected to said wheel assembly for rotating said wheel assembly about said vertical axis when said wheel assembly is in its raised position and thereby changing the orientation of said wheel assembly relative to said base unit.

35. The drilling structure of claim 34 including, said raising means comprising a vertically-disposed, double-acting hydraulic cylinder means.

36. The drilling structure of claim 34 including, said turning means including an angled bar connected at one end to said raising means and having an opposite bar end, and further including a cylinder means connected at one end to said opposite bar end and having an opposite cylinder end.

37. The drilling structure of claim 36 including, said opposite cylinder end being connected to said base unit.

38. A drilling structure comprising:

a base unit having a side positionable generally adjacent a well head, a friction reducing means supporting said base unit on a support surface and on which said base unit is movable, a drilling rig mast assembly positioned generally above and supported by said base unit, said base unit including a cantilever member extending out from and fixed in position relative to said side and spaced from the ground and having an outer portion spaced from said side, a leg means extending down from said outer portion and spaced from said side such that said side and said leg means are positionable on opposite sides of a well head, said leg means being movable between a lower support position and a higher raised position, a positioning means for positioning said drilling rig assembly on and relative to said cantilever member between an upright drilling position over said cantilever member and an upright drilling structure moving position disposed away from said cantilever member and closer to the center of gravity of said base unit than said drilling position, and a leg means moving means for moving said leg means to said lower support position before said positioning means has positioned said drilling rig assembly in said drilling position.

39. A drilling structure comprising:

a base unit having a side positionable generally adjacent a well head, a friction reducing means supporting said base unit on a support surface and on which said base unit is movable, said friction reducing means comprising a wheel assembly connected to said base unit, a drilling rig mast assembly positioned generally above and supported by said base unit, said base unit including a cantilever member extending out from and fixed in position relative to said side and spaced from the ground and having an outer portion spaced from said side, a leg means extending down from said outer portion and spaced from said side such that said side and said leg means are positionable on opposite sides of a well head, said leg means being movable between a lower support position and a higher raised position, a raising means for raising said wheel assembly directly vertically towards said base unit so that said base unit can rest on the support surface and for lowering said wheel assembly directly vertically away from said base unit so that said base unit is lifted off of the support surface and supported by said wheel assembly, said wheel assembly being continually positioned entirely beneath said base unit as it is raised and lowered by said raising means, said raising means defining a vertical axis about which said wheel assembly is rotatable, and a turning means for rotating said wheel assembly about said vertical axis to thereby change the orientation of said wheel assembly relative to said base unit.

40. A drilling structure comprising:

a base unit having a side positionable generally adjacent a well head, a friction reducing means supporting said base unit on a support surface and on which said base unit is movable, a drilling rig mast assembly positioned generally above and supported by said base unit, said base unit including a cantilever member extending out from and fixed in position relative to said side and spaced from the ground and having an outer portion spaced from said side, and a leg means extending down from said outer portion and spaced from said side such that said side and said leg means are positionable on opposite sides of a well head, said leg means being movable between a lower support position and a higher raised position, a positioning means for positioning said drilling rig mast assembly on and relative to said cantilever member between a drilling position over said cantilever member and a drilling structure moving position disposed away from said outer portion and closer to the center of gravity of said base unit than is said drilling position, and a drawworks connected to said drilling rig mast assembly and movable therewith, relative to said base unit, by said positioning means, and having its static load supported by said drilling rig assembly.

41. The drilling structure of claim 40 including, said drawworks including a crown pulley and traveling equipment.

42. The drilling structure of claim 40 including, said static load being supported in its entirety by said drilling rig assembly.

43. A method of moving a drilling structure relative to a well row comprising the following steps:

providing a drilling structure having a base unit, a wheel assembly connected to said base unit and movable horizontally relative to said base unit, said base unit having a side and a cantilever member extending out from and fixed in position relative to said side, a movable leg attached to and extending down from an outer portion of said cantilever member, and a drilling rig mast assembly supported by said base unit and movable on said cantilever member, said drilling rig being positioned in a drilling position wherein said base unit rests on a support surface adjacent a well head with said cantilever member extending over said well head and said leg resting on a support surface on the opposite side of said well head as said side and supporting said cantilever member, and said drilling rig mast assembly being positioned on said cantilever member over the well head, moving said drilling rig mast assembly along said cantilever member and on said base unit away from said leg towards the center of gravity of said base unit, positioning the lower end of said leg so that it is spaced above the support surface, raising said base unit so that it is supported on said wheel assembly, rolling said drilling rig on said wheel assembly to a new location, said rolling step including rolling said drilling rig to a new location whereat said side is positioned adjacent a second well head and said cantilever member extends over said second well head, lowering said base unit so that it rests on the support surface, after said drilling rig has been rolled to said new location, lowering the outer end of said leg until it rests on a support surface on the opposite side of said second well head as said side and so that it supports the outer portion of said cantilever member, and moving said drilling rig mast assembly along and on said cantilever member towards said leg until positioned in a drilling position over said second well head.

44. The method of claim 43 including, providing an extendable cylinder member having one end connected to said wheel assembly and the opposite end to said base unit, said raising said base unit step including extending said extendable cylinder member against said base unit so that said wheel assembly pushes against the support surface and said base unit is thereby lifted off of the support surface, and said lowering said base unit step including retracting said extendable cylinder member.

45. The method of claim 43 including, said moving said drilling mast assembly steps including skidding said drilling mast assembly along a lubricated surface of said base unit.

46. The method of claim 43 including, said moving said drilling mast assembly step including energizing a cylinder which is attached at one end to said drilling mast assembly and at its opposite end to said base unit.

47. The method of claim 43 including, said moving step including moving said drilling rig mast assembly in its vertical upright position relative to said base unit.

48. The method of claim 43 including, said raising step following said moving said drilling rig mast assembly away from said leg step.

49. A method of moving a drilling structure relative to a well row comprising the following steps:

providing a drilling structure having a base unit, a wheel assembly connected to said base unit and movable horizontally relative to said base unit, said base unit having a side and a cantilever member extending out from and fixed in position relative to said side, a movable leg attached to and extending down from an outer portion of said cantilever member, and a drilling rig mast assembly supported by said base unit and movable on said cantilever member, said drilling rig being positioned in a drilling position wherein said base unit rests on a support surface adjacent a well head with said cantilever member extending over said well head and said leg resting on a support surface on the opposite side of said well head as said side and supporting said cantilever member, and said drilling rig mast assembly being positioned on said cantilever member over the well head, moving said drilling rig mast assembly along said cantilever member and on said base unit away from said leg towards the center of gravity of said base unit, positioning the lower end of said leg so that it is spaced above the support surface, raising said base unit so that it is supported on said wheel assembly, thereafter, rolling said drilling rig on said wheel assembly to a new location, said rolling step including rolling said drilling rig in a direction perpendicular to and away from the well row to said new location, lowering said base unit at said new location until it is supported on the support surface, turning said wheel assembly relative to said base unit until said wheel assembly is oriented generally parallel to the well row, raising said base unit, after said turning step, so that it is supported by said wheel assembly, and thereafter, rolling said drilling structure on said wheel assembly in a direction generally parallel to the well row to a second location.

50. The method of claim 49 including, lowering said base unit at said second location until it rests on the support surface, turning said wheel assembly relative to said base unit until said wheel assembly is oriented towards a second well head spaced from said well head, rolling said drilling structure to said second well head so that said side is positioned adjacent said second well head and said cantilever member extends over said second well head, thereafter, lowering said base unit so that it rests on the support surface, lowering the outer end of said leg until it rests on a support surface on the opposite side of said second well head as said side and so that it supports the outer portion of said cantilever member, and thereafter, moving said drilling rig mast assembly on said cantilever member towards said leg until positioned in a drilling position over said second well head.

51. The method of claim 50 including, said lowering the outer end of said leg step including energizing a cylinder attached to said leg.

52. The method of claim 49 including, providing an extendable cylinder member having one end connected to said wheel assembly and the opposite end to said base unit, said raising said base unit step including extending said extendable cylinder member so that said wheel assembly pushes against the support surface and said base unit is thereby lifted off of the support surface, and said lowering said base unit step including retracting said extendable cylinder member.

53. The method of claim 49 including, said moving said drilling mast assembly step including skidding said drilling mast assembly along a lubricated surface of said base unit.

54. The method of claim 49 including, said moving said drilling mast assembly step including energizing a cylinder which is attached at one end to said drilling mast assembly and at its opposite end to said base unit.

* * * * *